US008040354B2

(12) United States Patent
Minamihama

(10) Patent No.: US 8,040,354 B2
(45) Date of Patent: Oct. 18, 2011

(54) IMAGE PROCESSING DEVICE, METHOD AND PROGRAM

(75) Inventor: Shinji Minamihama, Kanagawa (JP)

(73) Assignee: Sony Corporation, Tokyo (JP)

( * ) Notice: Subject to any disclaimer, the term of this patent is extended or adjusted under 35 U.S.C. 154(b) by 900 days.

(21) Appl. No.: 12/019,204

(22) Filed: Jan. 24, 2008

(65) Prior Publication Data

US 2008/0186317 A1 Aug. 7, 2008

(30) Foreign Application Priority Data

Feb. 7, 2007 (JP) ..... 2007-028395

(51) Int. Cl.
*G09G 5/39* (2006.01)
*G09G 5/36* (2006.01)

(52) U.S. Cl. ..... 345/531; 345/532; 345/547

(58) Field of Classification Search ..... 345/531, 345/532, 1.1, 1.3, 536, 545, 534, 544; 711/163, 711/167, 169, 170, 173
See application file for complete search history.

(56) References Cited

U.S. PATENT DOCUMENTS 6,411,302 B1 * 6/2002 Chiraz ..... 345/545
6,664,968 B2 * 12/2003 Ono ..... 345/532
6,747,655 B2 * 6/2004 Ono et al. ..... 345/502
2001/0026587 A1 10/2001 Hashimoto et al.

FOREIGN PATENT DOCUMENTS

JP 2001-285876 10/2001
JP 2003-348597 12/2003

OTHER PUBLICATIONS

James D. Foley, Andries van Dam, Steven K. Feiner, and John F. Hughes, "Computer Graphics: Principles and Practice", Jul. 1997, Addison-Wesley, Second Edition.*

* cited by examiner

*Primary Examiner* — Joni Hsu
*Assistant Examiner* — Sing-Wai Wu
(74) *Attorney, Agent, or Firm* — Oblon, Spivak, McClelland, Maier & Neustadt, L.L.P.

(57) ABSTRACT

There is provided an image processing device for controlling a display device to display a plurality of unit images making up a moving image at predetermined intervals, the image processing device including: 4×N (N: an arbitrary integer) quadrant memories; a separation section; a memory output control section; an assignment section; and an output control section.

6 Claims, 14 Drawing Sheets t2a
t2b
t2c
t2d
t2e
Hsync1/3
Hsync2/4
QUADRANT MEMORY 25Q1
QUADRANT MEMORY 25Q2
QUADRANT MEMORY 25Q3
QUADRANT MEMORY 25Q4
F4
F1
F2
F1
F2
F1
F2
F1
F2
F1
F2
F1
F2
F3
F4
F3
F4
F3
F4
F3
F4
F3
F4
F3
F4
F2
F3
F2
F3
F2
F3

IMAGE PROCESSING DEVICE, METHOD AND PROGRAM

CROSS REFERENCES TO RELATED APPLICATIONS

The present invention contains subject matter related to Japanese Patent Application JP 2007-028395 filed in the Japan Patent Office on Feb. 7, 2007, the entire contents of which being incorporated herein by reference.

BACKGROUND OF THE INVENTION

1. Field of the Invention

The present invention relates to an image processing device, method and program, and more particularly to an image processing device, method and program which provide memory control for a 4K signal at almost the same band (sample clock) as for a 2K signal so as to ensure reduced power consumption and easy handling of devices.

2. Description of the Related Art

As a result of the ever-increasing resolution of liquid crystal panels, those panels compatible with the video signal having an effective pixel count of 2048×1080 or so (refer to Japanese Patent Laid-Open No. 2003-348597 (Patent Document 1) and Japanese Patent Laid-Open No. 2001-285876 (Patent Document 2)), namely, the so-called high definition signal (referred to, however, as the "2K signal" in the present specification) are now becoming prevalent. Further, new liquid crystal panels are coming along which are compatible with the video signal having an effective pixel count of 4096×2160 or so, namely, the video signal with roughly four times the resolution of the 2K signal (hereinafter referred to as the "4K signal").

For this reason, the present inventor and applicant have been engaged in the development of projectors incorporating a 4K liquid crystal panel and their peripheral equipment as digital cinema projectors.

SUMMARY OF THE INVENTION

However, there is a problem with feeding the 4K signal to such a digital cinema projector. That is, if the 74.25 MHz clock is used as a sample clock for each pixel as with the 2K signal, and if the same frame memory is used as with the 2K signal, the time required to feed one frame of image data of the 4K signal (hereinafter referred to as the "frame data") to the frame memory, namely, frame data with 4096×2160 pixels (image frame: 5500×2250), is four frames of time (5500×2250/74.25 MHz=4 frames (24P)) for 74.25 MHz/24P.

As a result, there are two possible solutions to feeding frame data of the 4K signal within one frame of time, namely, feeding the data to the frame memory one frame at a time. One possible solution would be to increase the above sample clock frequency of 74.25 MHz more than four-fold (297 MHz or more including the overhead for accessing the frame memory). The other possible solution would be to increase the data width four-fold. However, both of these solutions would impose excessive load on devices, thus resulting in increased power consumption.

The present invention has been devised to solve the above problem. It is desirable to provide memory control for the 4K signal at almost the same band (sample clock) as for the 2K signal so as to ensure reduced power consumption and easy handling of devices.

An image processing device according to an embodiment of the present invention controls a display device to display a plurality of unit images making up a moving image. The display device sequentially displays the plurality of unit images at predetermined intervals. The image processing device includes 4×N (N: an arbitrary integer) quadrant memories, each associated with one of 4×N types of quadrant images into which the unit image is divided. The image processing device further includes a separation section adapted to separate a moving image signal for the moving image into unit image signals. Each of the unit image signals is associated with one of the 4×N unit images to be displayed successively in time. The image processing device still further includes a memory output control section. The memory output control section sequentially delays the output start timing of each of the 4×N unit image signals, separated by the separation section, to the quadrant memory by the predetermined interval as output control. Further, the memory output control section sequentially outputs quadrant image signals in a predetermined order over a period equal to 4×N times the predetermined interval. Each of the quadrant image signals is associated with one of the 4×N types of quadrant images. The image processing device still further includes an assignment section. The assignment section assigns and feeds each of the 4×N unit image signals, output under the control of the memory output control section, to one of the quadrant memories which is associated with the type of quadrant image signal output at that point in time. The image processing device still further includes an output control section. The output control section treats each of the 4×N unit images as an image to be displayed in a display order. The same section reads, at the predetermined intervals, the quadrant image signals, each of which is associated with one of the 4×N types of quadrant images into which the image to be displayed is divided. The same section reads the quadrant image signals from the 4×N types of quadrant memories and outputs the signals to the display device.

Each of the plurality of unit image signals making up the moving image signal is a frame or field signal with a resolution four times that permitted for a frame or field signal of a high definition signal. There are four types of the quadrant images, namely, first to fourth quadrant images. The quadrant images are four equal parts, two horizontal and two vertical, into which a field or frame is divided. The quadrant image signals, each associated with one of the first to fourth quadrant images, have the resolution permitted for the frame or field signal of the high definition signal.

The display device is a projector adapted to receive the moving image signal in a first format and project a moving image for the moving image signal. The separation section of the image processing device is supplied with the moving image signal in a second format different from the first format. Further, the memory output control section of the image processing device converts the moving image signal from the second to first format and performs the output control of the moving image signal in the first format.

The projector has four input lines for the quadrant image signals. The projector can project an original frame or field using the four quadrant image signals received through the four input lines. The memory output control section of the image processing device outputs the quadrant image signals in parallel to the four input lines of the projector. Each of the quadrant image signals is associated with one of the first to fourth quadrants of the frame or field to be displayed.

An image processing method and program according to an embodiment of the present invention are suitable for the aforementioned image processing device according to an aspect of the present invention.

The image processing device, method and program according to an embodiment of the present invention control a display device to display a plurality of unit images making up a moving image at predetermined intervals as follows. It should be noted that 4×N (N: an arbitrary integer) quadrant memories, each associated with one of 4×N types of quadrant images into which the unit image is divided, are used to perform such control. In this case, a moving image signal for the moving image is separated into unit image signals. Each of the unit image signals is associated with one of the 4×N unit images to be displayed successively in time. To control the output of the 4×N separated unit image signals to the quadrant memories, the output start timing of each of the unit image signals is sequentially delayed one at a time to match the output timing of a synchronizing signal output at the predetermined intervals. Further, quadrant image signals, each for one of the unit image signals, are sequentially output in a predetermined order in synchronism with the synchronizing signal. Each of the quadrant image signals is associated with one of the 4×N types of quadrant images. The aforementioned output control allows each of the unit image signals, which are output individually from each other, to be assigned and fed to the quadrant memory associated with the type of quadrant image signal output at that point in time. As a result, the 4×N unit images are treated as images to be displayed in a display order. The quadrant image signals, each of which is associated with one of the 4×N types of quadrant images into which the image to be displayed is divided, are read at the predetermined intervals. The quadrant image signals are read from the 4×N types of quadrant memories and output to the display device.

As described above, the present invention allows for handling of the 4K signal applicable to digital cinema and other applications. In particular, the present invention provides memory control for the 4K signal at almost the same band (sample clock) as for the 2K signal, ensuring reduced power consumption and easy handling of devices.

DETAILED DESCRIPTION OF THE PREFERRED EMBODIMENT

The preferred embodiment of the present invention will be described below. The correspondence between the requirements as set forth in the claims and the specific examples in the specification or drawings is as follows. This description is intended to confirm that the specific examples supporting the invention as defined in the appended claims are disclosed in the specification or drawings. Therefore, even if any specific example disclosed in the specification or drawings is not stated herein as relating to a requirement as set forth in an appended claim, it does not mean that the specific example does not relate to the requirement. On the contrary, even if a specific example is disclosed herein as relating to a requirement as set forth in an appended claim, it does not mean that the specific example does not relate to any other requirement.

Furthermore, the following description does not mean that an invention relating to a specific example disclosed in the specification or drawings as a whole is set forth in an appended claim. In other words, the following description does not deny existence of an invention relating to a specific example disclosed in the specification or drawings but not set forth in any appended claim, that is, an invention that will be added in future by divisional application or amending.

An image processing device according to an embodiment of the present invention (e.g., server 11 in FIG. 3) controls a display device (e.g., projector 12) to display a plurality of unit images making up a moving image. The display device sequentially displays the plurality of unit images in synchronism with a synchronizing signal (e.g., Vsync (24P) in FIG. 4 and other drawings) output at predetermined intervals.

The image processing device includes 4×N (N: an arbitrary integer) quadrant memories (e.g., quadrant memories 25Q1 to 25Q4 in FIG. 3), each associated with one of 4×N types of quadrant images (e.g., first to fourth quadrants Q1 to Q4 in FIGS. 2 and 3) into which the unit image is divided. The image processing device further includes a separation section (e.g., separation section 21 in FIG. 3) adapted to separate a moving image signal (e.g., coded stream data S of the 4K signal in FIG. 3) for the moving image into unit image signals (e.g., four pieces of coded frame data S1 to S4 in FIG. 3). Each of the unit image signals is associated with one of the 4×N unit images to be displayed successively in time.

Figure 3:
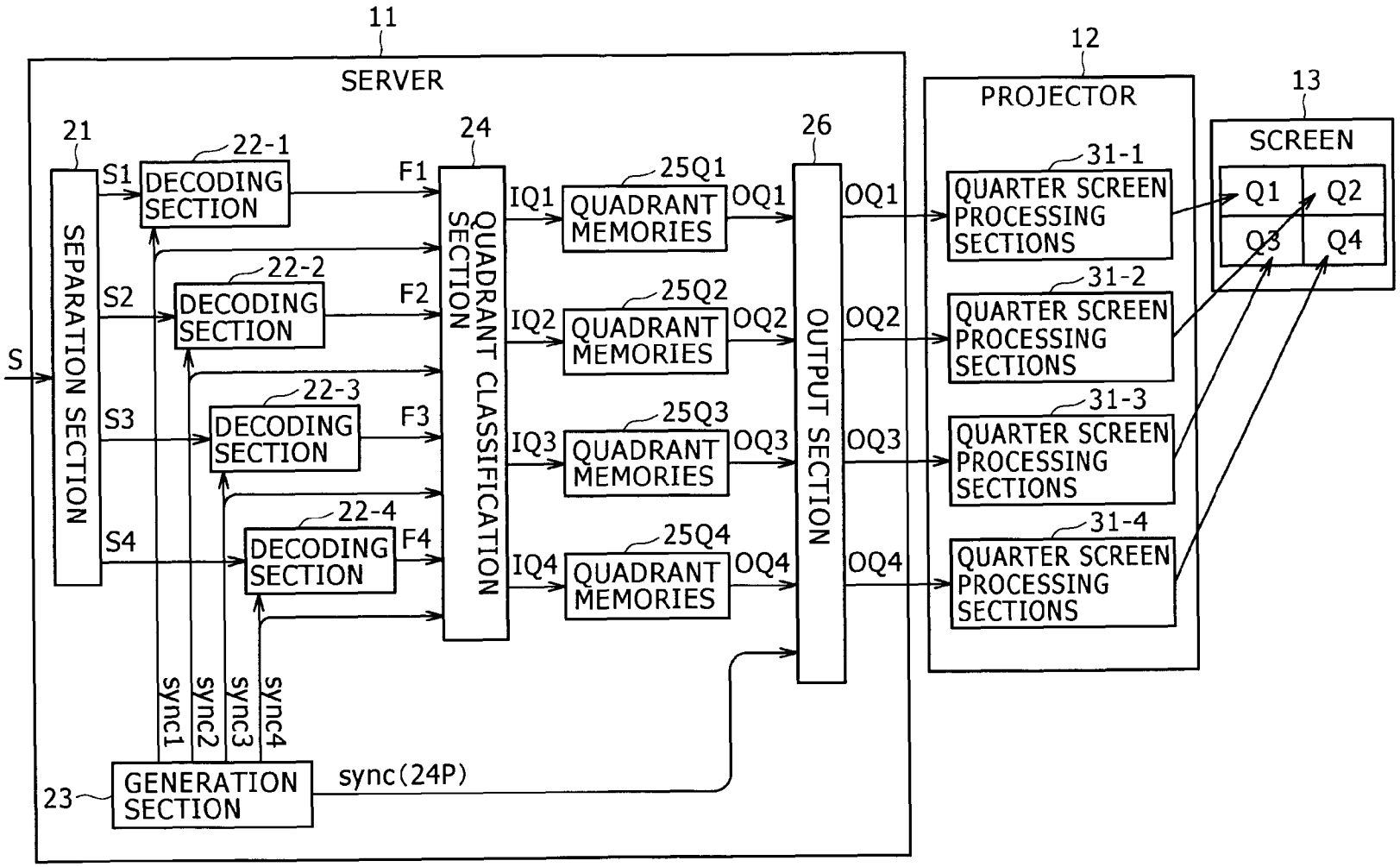
FIG. 3 is a block diagram illustrating a configuration example of an image processing system to which the present invention is applied.

The image processing device still further includes a memory output control section (e.g., generation section 23 adapted to generate sync1 to sync4 and decoding sections 22-1 to 22-4 adapted to decode sync1 to sync4 in the server 11 in FIG. 3). The memory output control section sequentially delays the output start timing of each of the 4×N unit image signals, separated by the separation section, to the quadrant memory by the predetermined interval as output control (refer, for example, to pieces of frame data F1 to F4 in the shaded areas of FIG. 4). Further, the memory output control section sequentially outputs quadrant image signals in a predetermined order over a period equal to 4×N times the predetermined interval. Each of the quadrant image signals is associated with one of the 4×N types of quadrant images (refer, for example, to the timing diagrams for the pieces of frame data F1 to F4 in FIGS. 4, 5, 7, 9 and 11).

The image processing device still further includes an assignment section (e.g., quadrant assignment section 24 in FIG. 3). The assignment section assigns and feeds each of the 4×N unit image signals, output under the control of the memory output control section, to one of the quadrant memories which is associated with the type of quadrant image signal output at that point in time (e.g., one of pieces of first to fourth quadrant data IQ1 to IQ4 in FIG. 3). (Refer, for example, to the timing diagrams of the quadrant memories 25Q1 to 25Q4 in FIGS. 6, 8, 10 and 12. More specifically, for example, the fourth quadrant data IQ4 is the type of quadrant image signal output as frame data F2, which is an example of the unit image signals, during a period from time t1*a* to time t1*b* in the example shown in FIG. 5. As illustrated in FIG. 6, therefore, the frame data F2 (fourth quadrant data IQ4 therein) is fed to the quadrant memory 25Q4 which is associated with the fourth quadrant Q4).

The image processing device still further includes an output control section (e.g., output section 26 in FIG. 3). The output control section treats each of the 4×N unit images as an image to be displayed in a display order. The same section reads, at the predetermined intervals, the quadrant image signals (e.g., first to fourth quadrant data OQ1 to OQ4 in FIG. 3), each of which is associated with one of the 4×N types of quadrant images into which the image to be displayed is divided. The same section reads the quadrant image signals from the 4×N types of quadrant memories and outputs the signals to the display device (refer, for example, to FIG. 13).

An image processing method and program according to an embodiment of the present invention are suitable for the aforementioned image processing device according to an aspect of the present invention. The program may be executed, for example, by a computer in FIG. 14 which will be described later.

The present invention having various embodiments as described above is applicable not only to the 4K signal but also to the 2K signal and other image data with a lower resolution. The present invention is also applicable to image data with a higher resolution than the 4K signal which will come along in the future.

Figure 1:
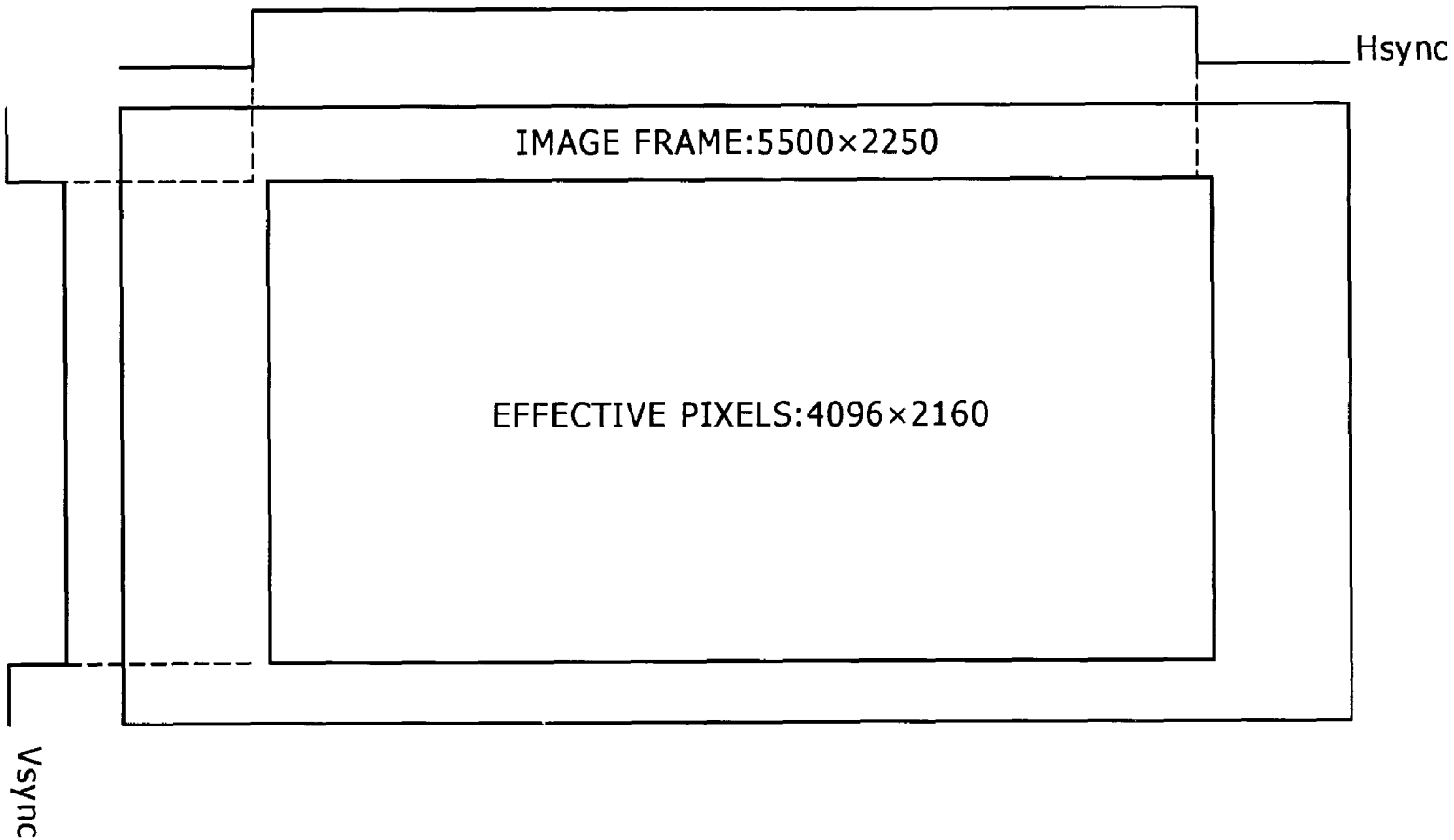
FIG. 1 is a view describing the display resolution of a 4K signal.

To clearly demonstrate that the problem described in "SUMMARY OF THE INVENTION" can be solved, however, the present embodiment handles image data of the 4K signal having an image frame pixel count of 5500×2250 and an effective pixel count of 4096×2160, as illustrated in FIG. 1.

As one of the features, the present invention performs frame memory control by dividing a frame image of the 4K signal (image in the effective pixel area) into 4×N (N: an arbitrary integer) identically shaped regions and providing a frame memory for each of these regions. That is, pixel data with 4096×2160 effective pixels making up the 4K signal frame data is divided into pixel data groups, each of which is contained in one of the regions. The group of image data for each region is stored in a frame memory associated with that region.

Figure 2:
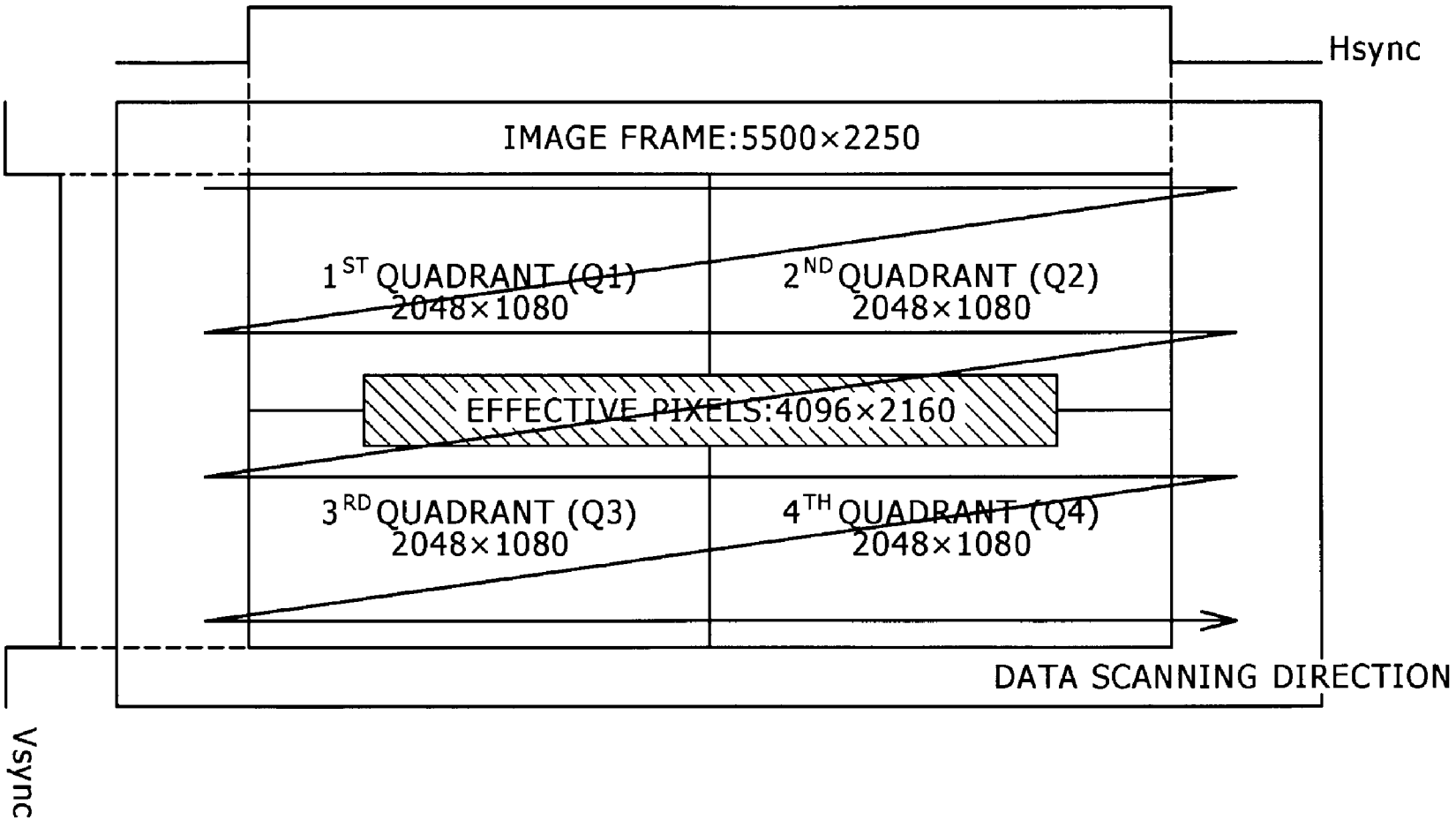
FIG. 2 is a view describing a feature of the present invention.

We assume, however, that N=1 in the present embodiment for simplification of the description as illustrated in FIG. 2. That is, we assume that a frame image is divided into four equal parts, two vertical and two horizontal parts, and that four frame memories, each associated with one of the four parts or regions, are used.

The four regions into which a frame image is divided will be referred to as follows in accordance with the description of FIG. 2. That is, the top left region will be referred to as the first quadrant Q1, the top right region the second quadrant Q2, the bottom left region the third quadrant Q3, and the bottom right region the fourth quadrant Q4. Further, information, blocks and others relating to the first, second, third and fourth quadrants Q1, Q2, Q3 and Q4 will be denoted by the reference numerals Q1, Q2, Q3 and Q4 of the respective regions to clarify the relationship therebetween.

On the other hand, a frame memory associated with one of the first to fourth quadrants Q1 to Q4 will be referred to as a quadrant memory. That is, although functioning in the same manner as an existing frame memory, a quadrant memory stores not the entire frame data but a pixel data group (hereinafter referred to as "quadrant data") belonging to the quadrant with which the quadrant memory is associated. That is, this clearly indicates that a quadrant memory stores only data of the predetermined quadrant.

That is, the present embodiment assigns frame data of the 4K signal as the first, second, third and fourth pieces of quadrant data and stores these pieces of data respectively in the quadrant memories (refer to the quadrant memories 25Q1 to 25Q4 in FIG. 3) which are respectively associated with the first to fourth quadrants Q1 to Q4.

In this case, each piece of the quadrant data is arranged sequentially in the order indicated by the data scanning direction shown in FIG. 2 to make up frame data which serves as stream data (refer to FIGS. 4 to 11 which will be described later).

Further, the present embodiment separates image data of the 4K signal into four pieces of frame data to be displayed successively in time. These four pieces of frame data serve as one unit. The quadrant memories are controlled for each unit of frame data. That is, each of the four pieces of frame data contained in each unit is sequentially stored in the associated type of quadrant memory. The four pieces of frame data are stored in the quadrant memories over a period of four frames (24P) of time (time equal to four periods of Vsync (24P)) with a delay of one frame (24P) from each other. It should be noted, however, that a detailed description thereof will be given later with reference to FIGS. 4 to 12.

As a result of the above, the present embodiment provides memory control for the 4K signal at almost the same band (sample clock) as for the 2K signal, thus ensuring reduced power consumption and easy handling of devices. A detailed description thereof will be given later.

A description will be given below of an embodiment of an image processing system to which the present invention is applied with reference to the accompanying drawings.

FIG. 3 illustrates a block diagram of an image processing system to which the present invention is applied.

The image processing system in the example of FIG. 3 includes a server 11, a projector 12 and a screen 13.

The server 11 includes components ranging from the separation section 21 to the output section 26.

In the present embodiment, the 4K signal is supplied to the server 11 in the form of coded stream data S. This data is compression-coded, for example, by JPEG2000 (Joint Photographic Experts Group 2000).

More specifically, the coded stream data S is fed, for example, to the separation section 21 of the server 11 in the present embodiment. The separation section 21 separates the coded stream data S into one unit of coded stream data made up of four frames to be displayed successively in time. Further, the same section 21 separates the unit of coded stream data into four pieces of the coded frame data S1 to S4. Then, the same section 21 supplies the first coded frame data S1 to the decoding section 22-1, the second coded frame data S2 to the decoding section 22-2, the third coded frame data S3 to the decoding section 22-3, and the fourth coded frame data S4 to the decoding section 22-4.

The decoding sections 22-1 to 22-4 respectively decode the first to fourth pieces of coded frame data S1 to S4 in synchronism with sync1 to sync4 from the generation section 23 according to the predetermined format (e.g., JPEG2000). The same sections 22-1 to 22-4 supply the decoded pieces of frame data F1 to F4 to the quadrant assignment section 24.

The generation section 23 generates and supplies a sync (24P) to the output section 26. The same section 23 generates the sync1 to sync4 based on the sync (24P) and supplies these signals respectively to the decoding sections 22-1 to 22-4 and also to the quadrant assignment section 24. The sync1 to sync4 will be described later with reference to FIGS. 4 to 12.

The quadrant assignment section 24 identifies each piece of the frame data F1 to F4 to determine which of the four data types, namely, the first to fourth quadrant data IQ1 to IQ4, the currently input quadrant data fits into. This identification is carried out, for example, based on the sync1 to sync4 from the generation section 23. The quadrant assignment section 24 assigns the quadrant data, whose type has been identified, to one of the quadrant memories 25Q1 to 25Q4 which is associated with the identified type and stores the data in that quadrant memory.

Here, we assume that the quadrant memories 25Q1 to 25Q4 are associated respectively with the first to fourth quadrants Q1 to Q4. In this case, if quadrant data currently fed as the frame data F1 is the third quadrant data IQ3, the frame data F1 (third quadrant data IQ3 therein) is assigned and stored in the quadrant memory 25Q3.

In this case, four pieces of frame data F1 to F4 are fed to the quadrant assignment section 24 over a period of four frames (24P) of time (time equal to four periods of Vsync (24P)) with a delay of one frame (24P) from each other. At any given time, therefore, there is no overlap in data type between the pieces of quadrant data fed as the pieces of frame data F1 to F4. As a result, all the pieces of data are properly assigned respectively to the appropriate quadrant memories, that is, the quadrant memories 25Q1 to 25Q4. It should be noted that the quadrant data types refer to the first to fourth quadrant data IQ1 to IQ4. A detailed description thereof will be given later with reference to FIGS. 4 to 12.

The output section 26 treats the pieces of frame data F1 to F4 as images to be displayed sequentially in that order (display order) in synchronism with the sync (24P) from the generation section 23. For frame data Fk (k: any of 1 to 4) to be displayed, the same section 26 reads the pieces of first to fourth pieces of quadrant data OQ1 to OQ4 in parallel respectively from the quadrant memories 25Q1 to 25Q4 and outputs these pieces of data to the projector 12. A detailed description thereof will be given later with reference to FIG. 13.

In the present embodiment, the projector 12 has four input lines for the 2K signal. On the other hand, the first to fourth pieces of quadrant data OQ1 to OQ4 are image data, each piece of which has the same resolution as the 2K signal. As a result, the first to fourth pieces of quadrant data OQ1 to OQ4 for the frame data Fk to be displayed are fed in parallel to the projector 12 in an as-is form.

The projector 12 has quarter screen processing sections 31-1 to 31-4 on the screen 13. The quarter screen processing sections 31-1 to 31-4 are adapted to control the projection of pixel groups (images) of the first to fourth quadrants Q1 to Q4. That is, the same sections 31-1 to 31-4 control the projection of the pixel groups (images), associated respectively with the first to fourth pieces of quadrant data OQ1 to OQ4 for the frame data Fk to be displayed, respectively onto the first to fourth quadrants Q1 to Q4 of the screen 13. It should be noted, however, that the data scanning direction in this case is in accordance with that in FIG. 2. As a result, the entire frame image associated with the frame data Fk to be displayed appears on the screen 13.

Next, an operation example of the server 11 will be described with reference to FIGS. 4 to 13.

Figure 4:
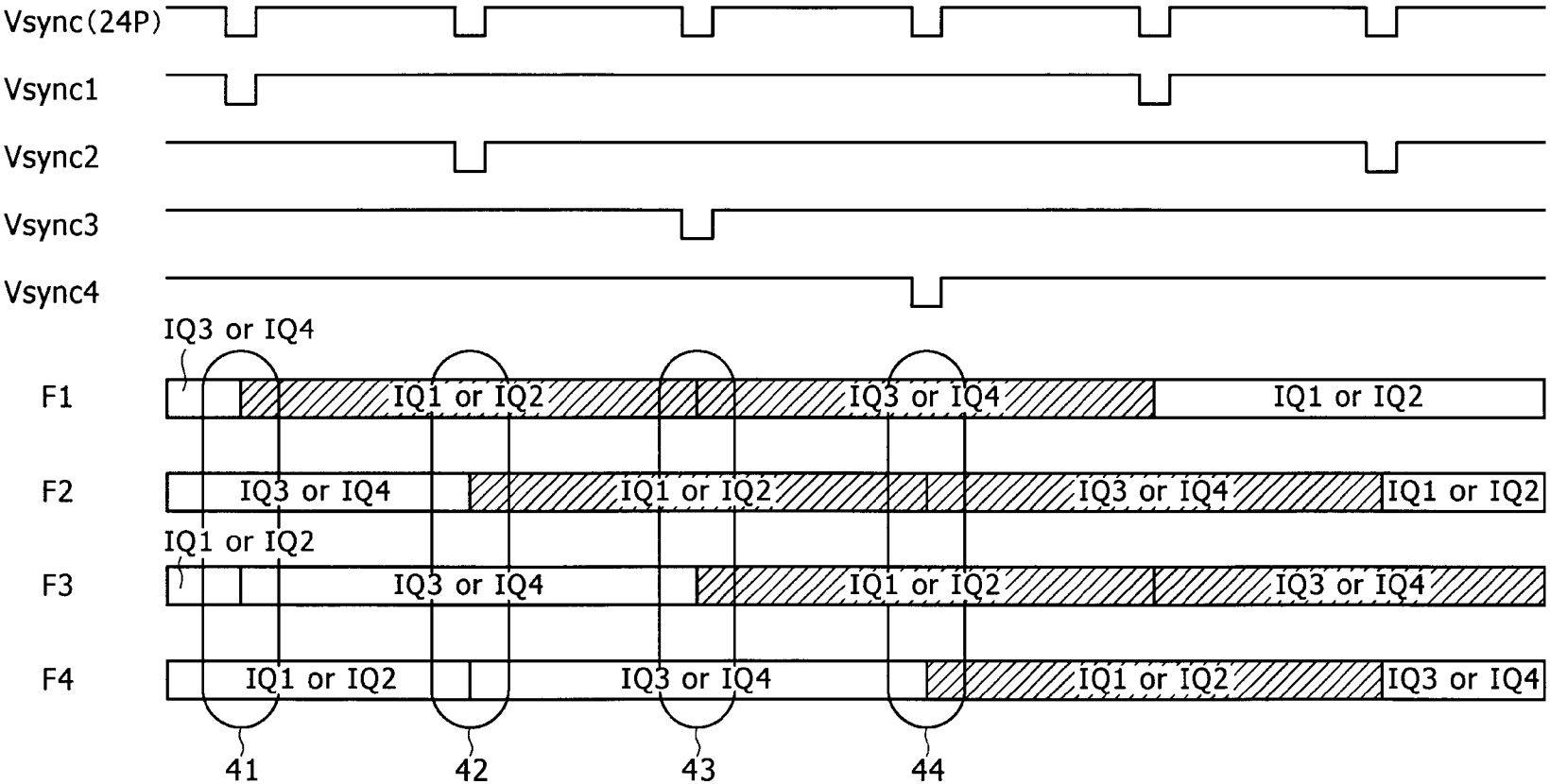
FIG. 4 is a timing diagram for describing input control adapted to feed data to quadrant memories of a server shown in FIG. 3.

FIG. 4 is a timing diagram for describing an operation example of the quadrant assignment section 24, that is, storage of frame data in (feeding of data to) the quadrant memories 25Q1 to 25Q4.

FIG. 4 illustrates, from top to bottom, timing diagrams of the Vsync (24p), Vsync1 to Vsync4 and pieces of frame data F1 to F4.

It should be noted that data from the decoding section 22-p (p: any arbitrary integer from 1 to 4) is practically stream data. Assuming that four frames make up one unit as described above, the pieces of frame data Fp contained in a plurality of units (data in the shaded areas of FIG. 4) are arranged successively in stream data as illustrated in the timing diagrams of the frame data Fp in FIG. 4.

In other words, if four frames make up one unit, decoding of one unit by the decoding section 22-p means decoding of the pth frame among the four frames. Therefore, the frame data Fp for the pth frame among the four frames is output from the decoding section 22-p as a result of the decoding of a given unit at a given time. It should be noted, however, that such a decoding of one unit is successively repeated in practical decoding. As a result, the decoding section 22-p outputs stream data without interruption.

To facilitate the understanding of the present invention, however, a description will be given below focusing on the decoding of a given unit (decoding of the four pieces of frame data F1 to F4) at a given time. That is, we assume that the frame data Fp means the pieces of data shown in the shaded areas of FIG. 4, namely, the frame data of the pth frame among the four frames contained in one unit at a given time.

As illustrated in FIG. 4, the Vsync1 to Vsync4 are signals each having a period of four frames (24P) of time (which corresponds to four periods of the Vsync (24P)) and shifted by one frame (24P) of time (which corresponds to one period of the Vsync (24P)) from each other. The Vsync1 to Vsync4 are generated by the generation section 23 based on the Vsync (24P) and supplied respectively to the decoding sections 22-1 to 22-4 and also to the quadrant assignment section 24. The decoding sections 22-1 to 22-4 decode one unit, namely, the pieces of coded frame data S1 to S4, respectively in synchronism with the Vsync1 to Vsync4.

As a result, the four pieces of frame data F1 to F4 (represented by the pieces of data in the shaded areas in FIG. 4) are output respectively from the decoding sections 22-1 to 22-4 over a period of four frames (24P) of time and fed to the quadrant assignment section 24 with a shift of one frame (24P) of time from each other. In other words, the four pieces of frame data F1 to F4 are delayed in output timing by one frame (24P) of time from each other. That is, these pieces of data are output respectively at times t1 to t4.

On the other hand, the four pieces of frame data F1 to F4 (represented by the pieces of data in the shaded areas in FIG. 4) are stream data made up of pieces of pixel data arranged sequentially in the data scanning direction of FIG. 2, as described above.

Therefore, the pieces of data fed to the quadrant assignment section 24 at any given time as the pieces of frame data F1 to F4 are the first to fourth quadrant data IQ1 to IQ4 which never overlaps with each other.

Figure 5:
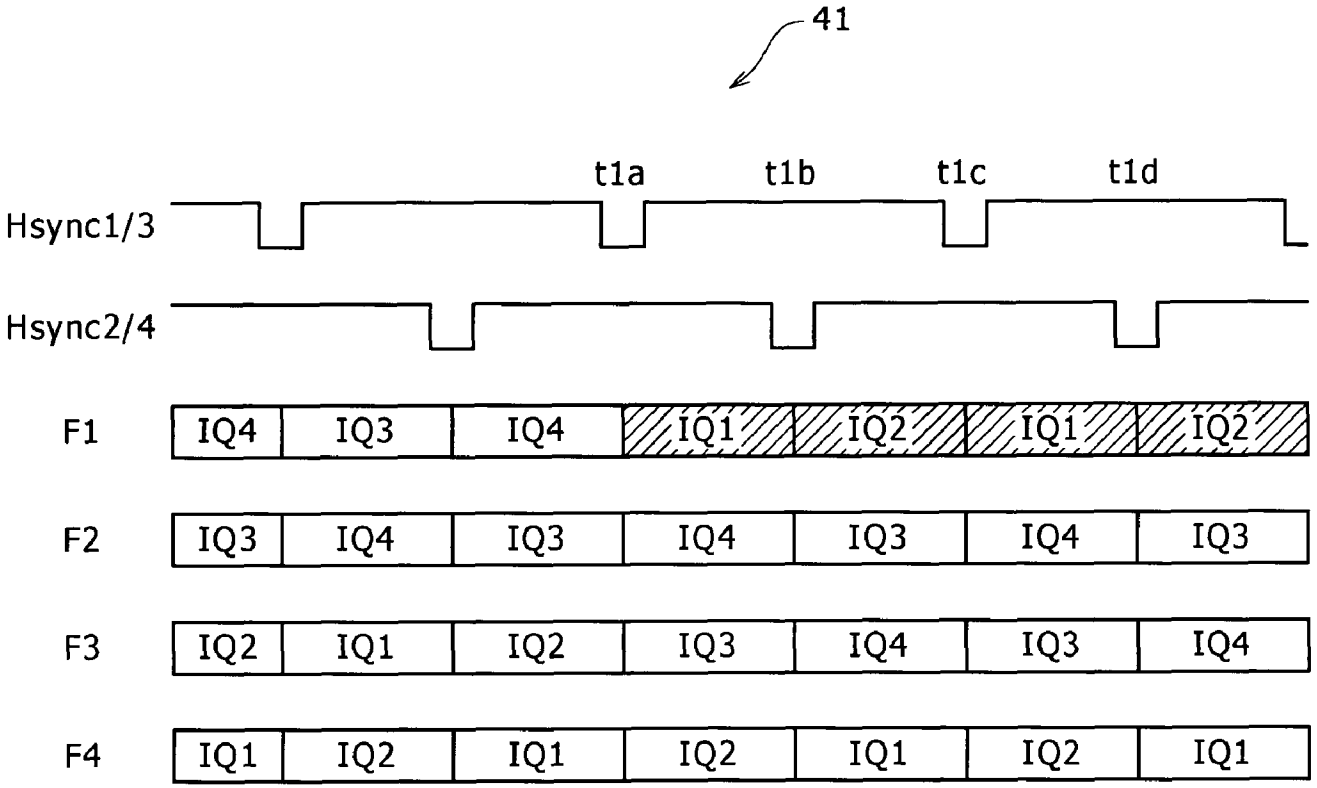
FIG. 5 is a timing diagram for describing the input control adapted to feed data to the quadrant memories of the server shown in FIG. 3.
Figure 6:
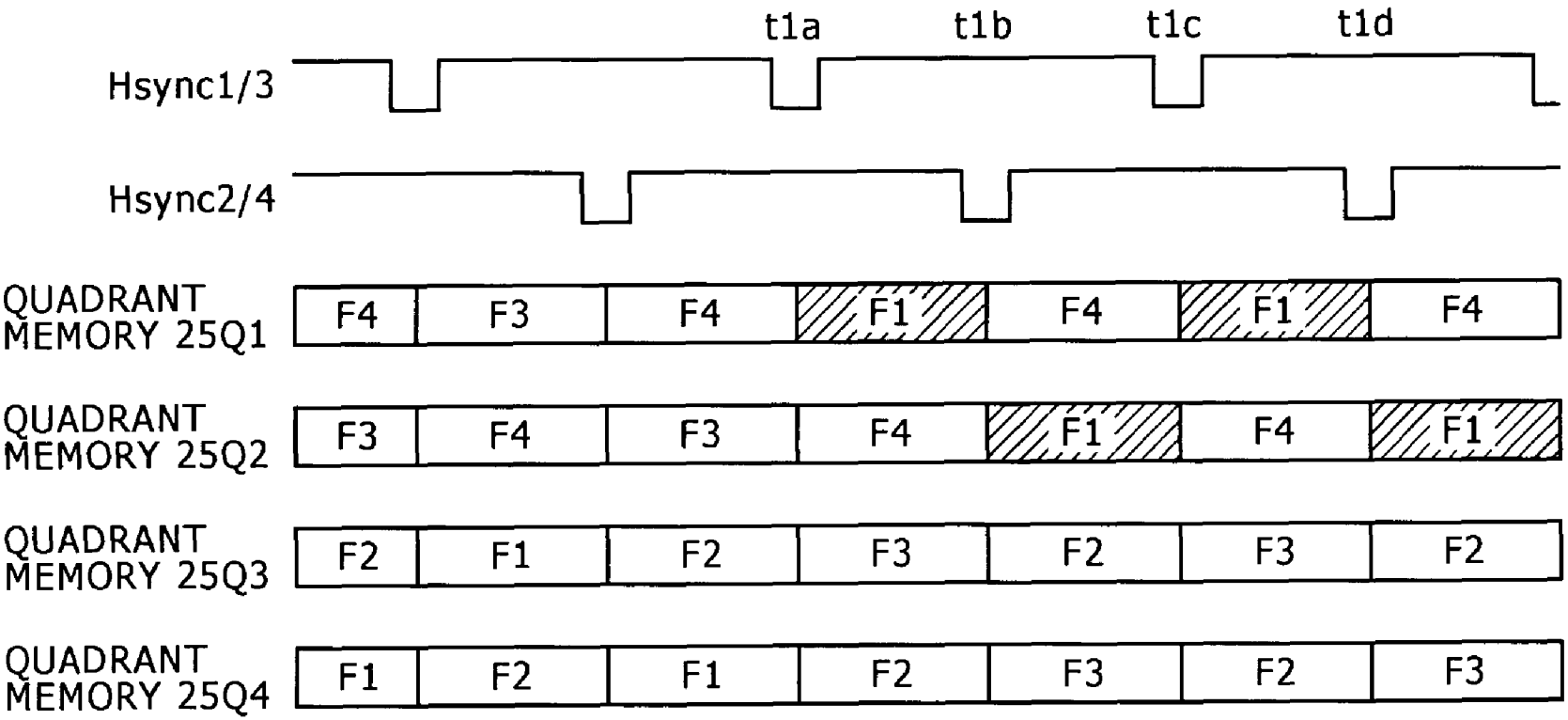
FIG. 6 is a timing diagram for describing the input control adapted to feed data to the quadrant memories of the server shown in FIG. 3.

More specifically, FIG. 5 illustrates an enlarged view of a timing diagram 41 near time t1 in FIG. 4. It should be noted that a timing diagram of Hsync1/3 and Hsync2/4 is also shown at the top in the example of FIG. 5.

The Hsync1/3 is either a Hsync1 or Hsync3 which has the same period as a Hsync (24P), namely, a period of one line of time. The Hsync2/4 is either a Hsync2 or Hsync4 which has the same period as a Hsync (24P), namely, a period of one line of time. It should be noted that the Hsync1/3 and Hsync2/4 are shifted by half a period, namely, a time corresponding to half a line, from each other. The Hsync1 to Hsync4 are generated by the generation section 23 based on the Hsync (24P) and supplied respectively to the decoding sections 22-1 to 22-4 and also to the quadrant assignment section 24.

During a period from time t1*a* when the Hsync1/3 is output to time t1*b* when the Hsync2/4 is output, the first to fourth quadrant data IQ1 to IQ4 is fed to the quadrant assignment section 24, for example, as follows. That is, the first quadrant data IQ1 is fed as the frame data F1, the fourth quadrant data IQ4 as the frame data F2, the third quadrant data IQ3 as the frame data F3, and the second quadrant data IQ2 as the frame data F4.

It is clear from the above that the pieces of data fed to the quadrant assignment section 24 as the frame data F1 to F4 from time t1*a* to time t1*b* are the first to fourth quadrant data IQ1 to IQ4 which does not overlap with each other.

It should be noted that the frame data F2 from time t1*a* to time t1*b* is the fourth quadrant data IQ4 for the second frame of the previous unit (unit made up of four frames separated in the previous process by the separation section 21). Similarly, the frame data F3 from time t1*a* to time t1*b* is the third quadrant data IQ3 for the third frame of the previous unit. The frame data F4 from time t1*a* to time t1*b* is the second quadrant data IQ2 for the fourth frame of the previous unit.

In this case, the quadrant assignment section 24 can recognize, based on the sync1 (Vsync1 and Hsync1) from the generation section 23, that it has received the first quadrant data IQ1 as the frame data F1 from time t1*a* to time t1*b*. Therefore, the same section 24 can assign and feed (store) the frame data F1 (first quadrant data IQ1 therein) to (in) the quadrant memory 25Q1 as illustrated in FIG. 6.

That is, FIG. 6 illustrates a timing diagram of the quadrant memories 25Q1 to 25Q4 in the same time zone as the timing diagram 41 of FIG. 5. It should be noted that the timing diagram of the quadrant memories 25Q1 to 25Q4 shows which of the four pieces of frame data F1 to F4 is fed to (stored in) the memories at each time.

Further, the quadrant assignment section 24 can recognize, based on the sync2 (Vsync2 and Hsync2) from the generation section 23, that it has received the fourth quadrant data IQ4 as the frame data F2 from time t1*a* to time t1*b*. Therefore, the same section 24 can assign and feed (store) the frame data F2 (fourth quadrant data IQ4 therein) to (in) the quadrant memory 25Q4 as illustrated in FIG. 6.

In the same manner as above, the quadrant assignment section 24 can recognize, based on the sync3 (Vsync3 and Hsync3) from the generation section 23, that it has received the third quadrant data IQ3 as the frame data F3 from time t1*a* to time t1*b*. Therefore, the same section 24 can assign and feed (store) the frame data F3 (third quadrant data IQ3 therein) to (in) the quadrant memory 25Q3 as illustrated in FIG. 6.

The quadrant assignment section 24 can recognize, based on the sync4 (Vsync4 and Hsync4) from the generation section 23, that it has received the second quadrant data IQ2 as the frame data F4 from time t1*a* to time t1*b*. Therefore, the same section 24 can assign and feed (store) the frame data F4 (second quadrant data IQ2 therein) to (in) the quadrant memory 25Q2 as illustrated in FIG. 6.

Also, during a period from time t1*b* when the Hsync2/4 is output to time tic when the Hsync1/3 is output, the first to fourth quadrant data IQ1 to IQ4 is fed to the quadrant assignment section 24, for example, as illustrated in FIG. 5. That is, the second quadrant data IQ2 is fed as the frame data F1, the third quadrant data IQ3 as the frame data F2, the fourth quadrant data IQ4 as the frame data F3, and the first quadrant data IQ1 as the frame data F4.

It is clear from the above that the pieces of data fed to the quadrant assignment section 24 as the frame data F1 to F4 from time t1*b* to time tic are also the first to fourth quadrant data IQ1 to IQ4 which does not overlap with each other.

It should be noted that the frame data F2 from time t1*b* to time t1*c* is the third quadrant data IQ3 for the second frame of the previous unit (unit made up of four frames separated in the previous process by the separation section 21). Similarly, the frame data F3 from time t1*b* to time t1*c* is the fourth quadrant data IQ4 for the third frame of the previous unit. The frame data F4 from time t1*b* to time t1*c* is the first quadrant data IQ1 for the fourth frame of the previous unit.

In this case, the quadrant assignment section 24 can recognize, based on the sync1 (Vsync1 and Hsync1) from the generation section 23, that it has received the second quadrant data IQ2 as the frame data F1 from time t1*b* to time t1*c*. Therefore, the same section 24 can assign and feed (store) the frame data F1 (second quadrant data IQ2 therein) to (in) the quadrant memory 25Q2 as illustrated in FIG. 6.

Further, the quadrant assignment section 24 can recognize, based on the sync2 (Vsync2 and Hsync2) from the generation section 23, that it has received the third quadrant data IQ3 as the frame data F2 from time t1*b* to time t1*c*. Therefore, the same section 24 can assign and feed (store) the frame data F2 (third quadrant data IQ3 therein) to (in) the quadrant memory 25Q3 as illustrated in FIG. 6.

In the same manner as above, the quadrant assignment section 24 can recognize, based on the sync3 (Vsync3 and Hsync3) from the generation section 23, that it has received the fourth quadrant data IQ4 as the frame data F3 from time t1*b* to time t1*c*. Therefore, the same section 24 can assign and feed (store) the frame data F3 (fourth quadrant data IQ4 therein) to (in) the quadrant memory 25Q4 as illustrated in FIG. 6.

The quadrant assignment section 24 can recognize, based on the sync4 (Vsync4 and Hsync4) from the generation section 23, that it has received the first quadrant data IQ1 as the frame data F4 from time t1*b* to time t1*c*. Therefore, the same section 24 can assign and feed (store) the frame data F4 (first quadrant data IQ1 therein) to (in) the quadrant memory 25Q1 as illustrated in FIG. 6.

As described above, the pieces of data fed to the quadrant assignment section 24 as the frame data F1 to F4 at any given time near time t1 in FIG. 4 are the first to fourth quadrant data IQ1 to IQ4 which does not overlap with each other. In other words, the pieces of data respectively assigned and fed to (stored in) the quadrant memories 25Q1 to 25Q4 as the first to fourth quadrant data IQ1 to IQ4 do not overlap with each other.

Figure 7:
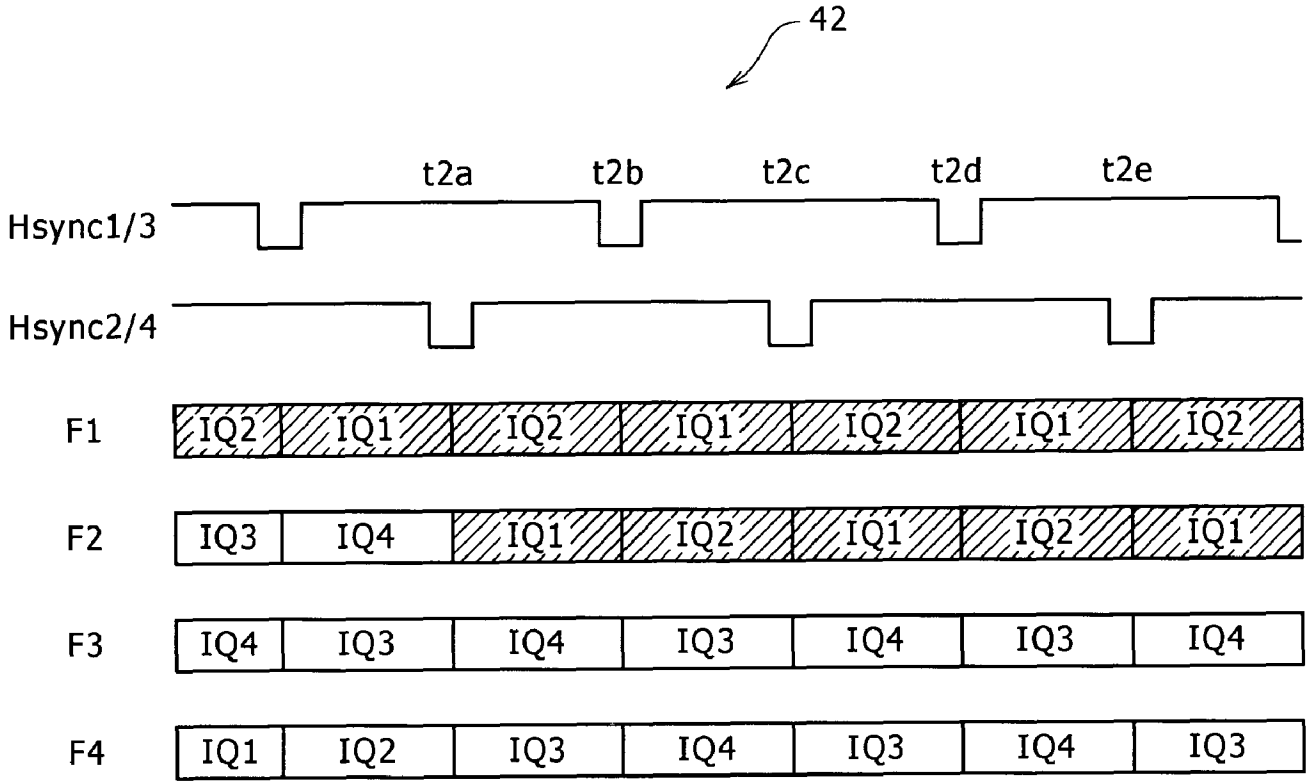
FIG. 7 is a timing diagram for describing the input control adapted to feed data to the quadrant memories of the server shown in FIG. 3.
Figure 8:
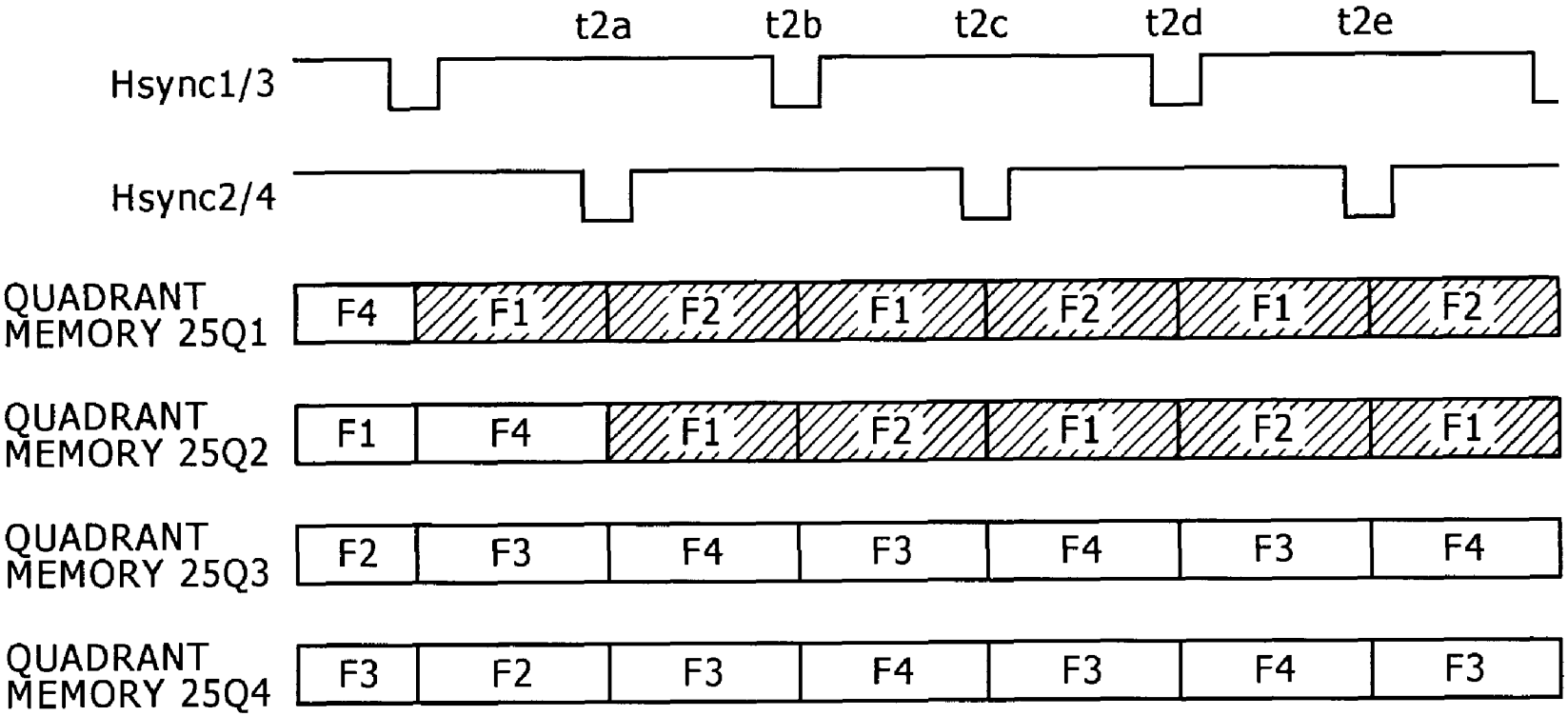
FIG. 8 is a timing diagram for describing the input control adapted to feed data to the quadrant memories of the server shown in FIG. 3.
Figure 9:
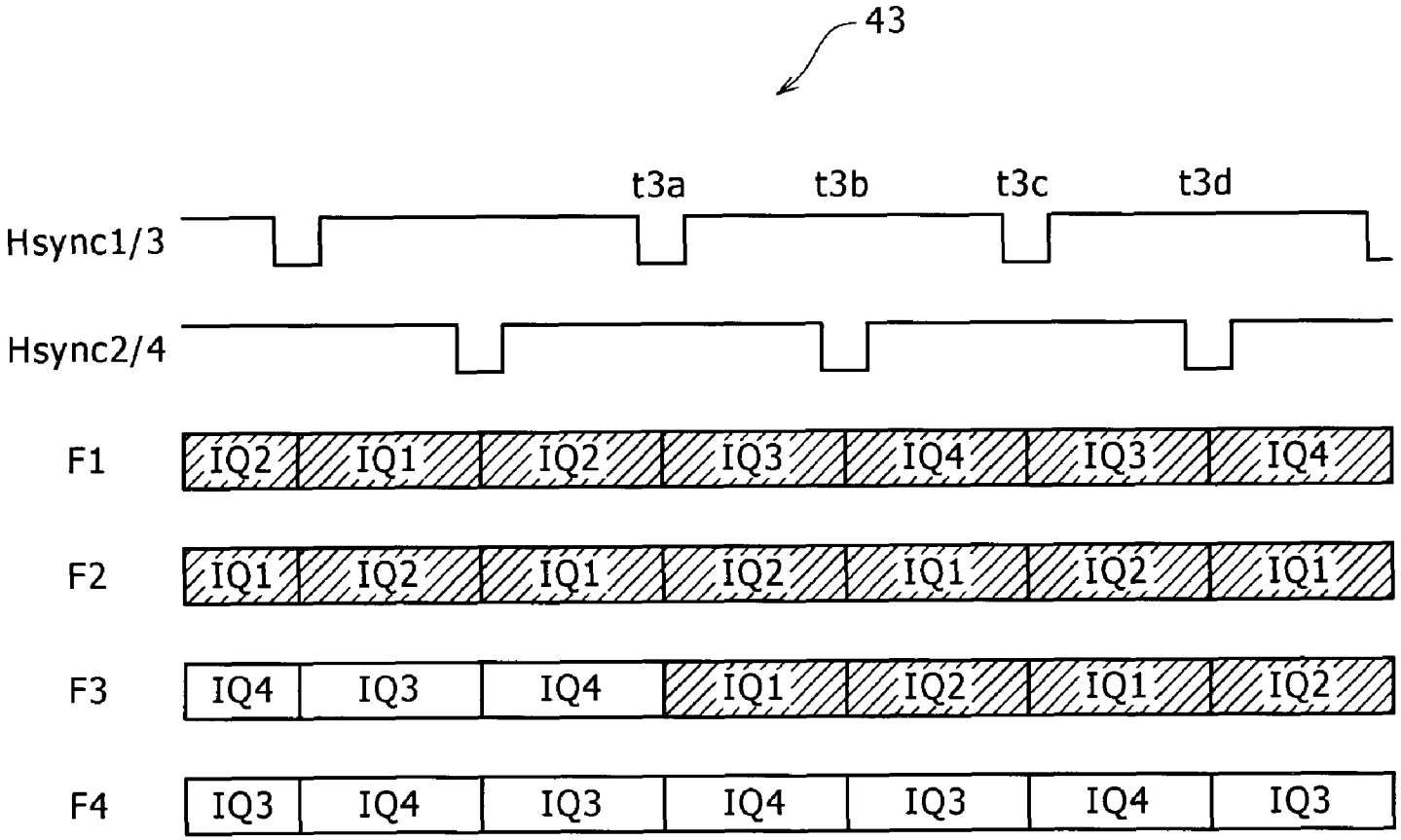
FIG. 9 is a timing diagram for describing the input control adapted to feed data to the quadrant memories of the server shown in FIG. 3.
Figure 10:
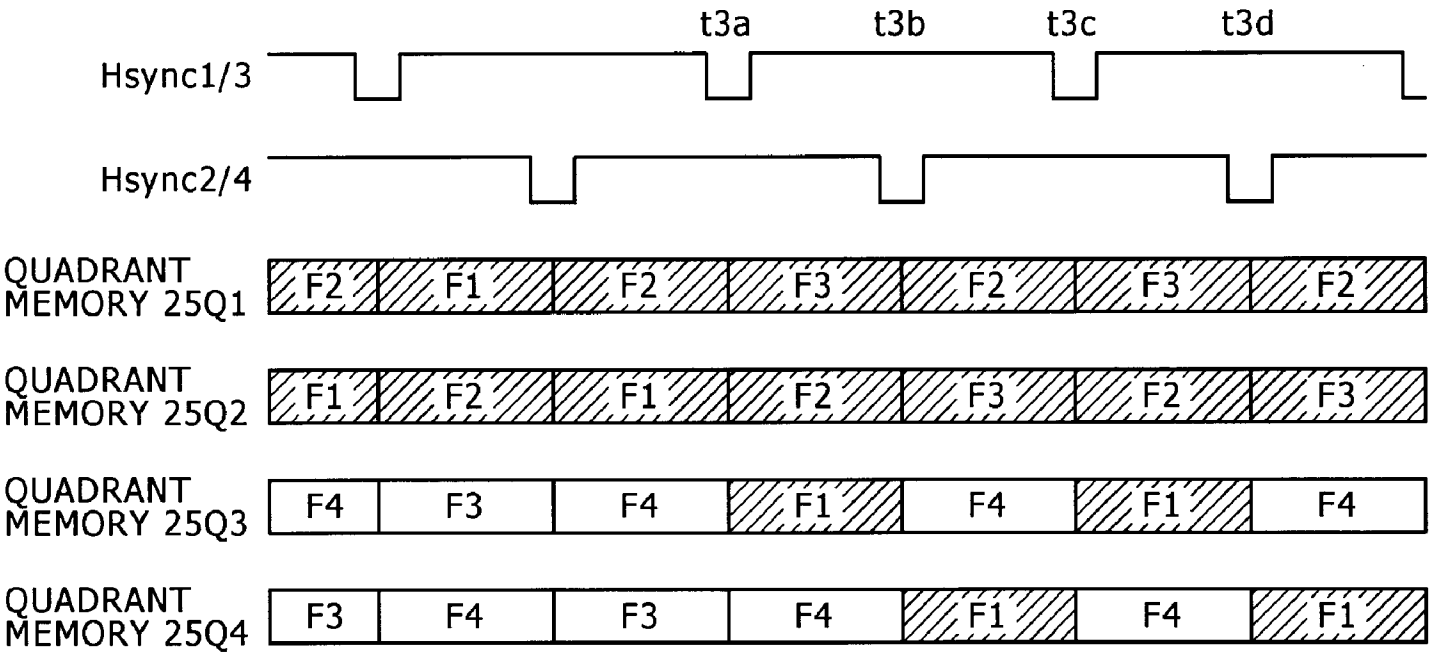
FIG. 10 is a timing diagram for describing the input control adapted to feed data to the quadrant memories of the server shown in FIG. 3.
Figure 11:
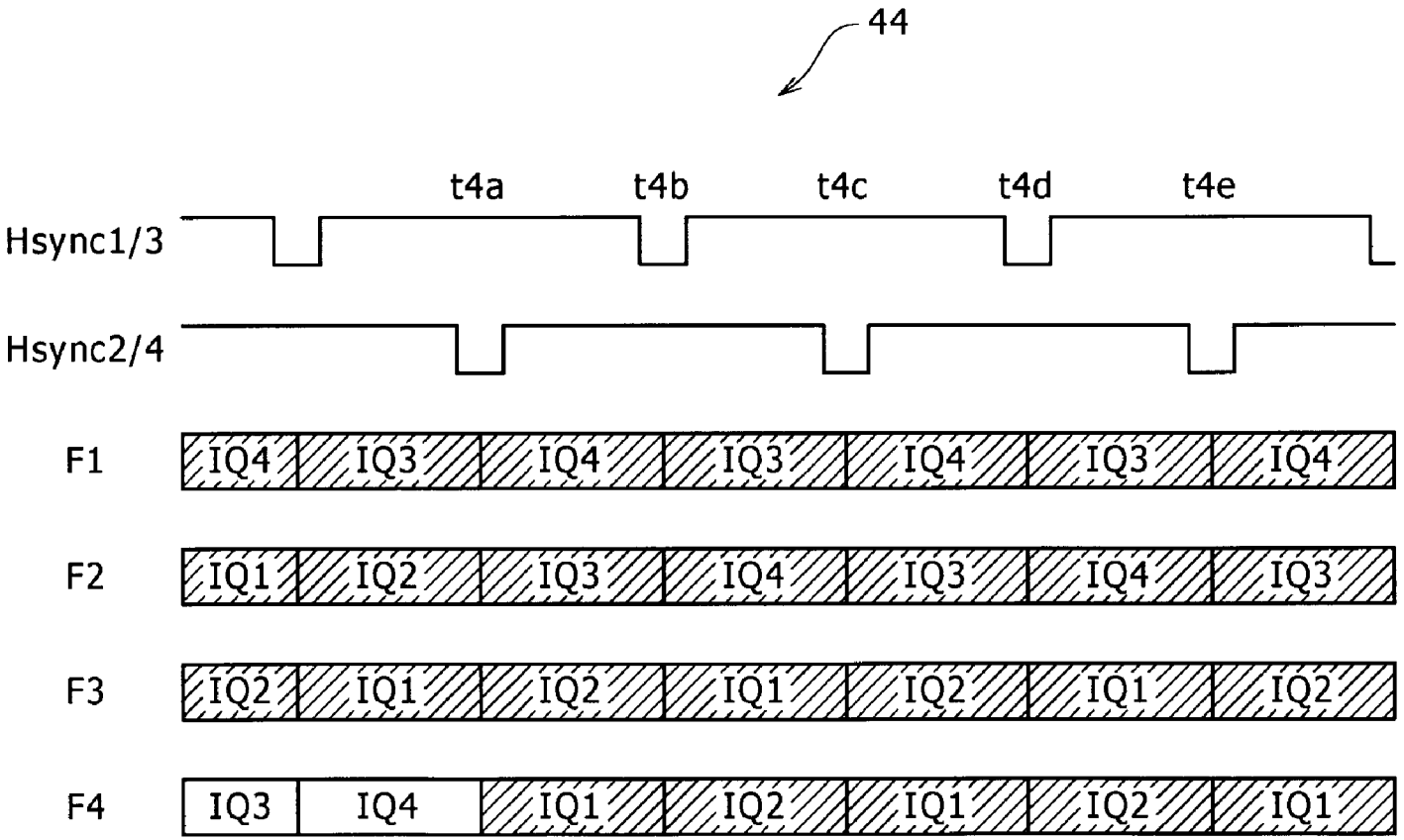
FIG. 11 is a timing diagram for describing the input control adapted to feed data to the quadrant memories of the server shown in FIG. 3.
Figure 12:
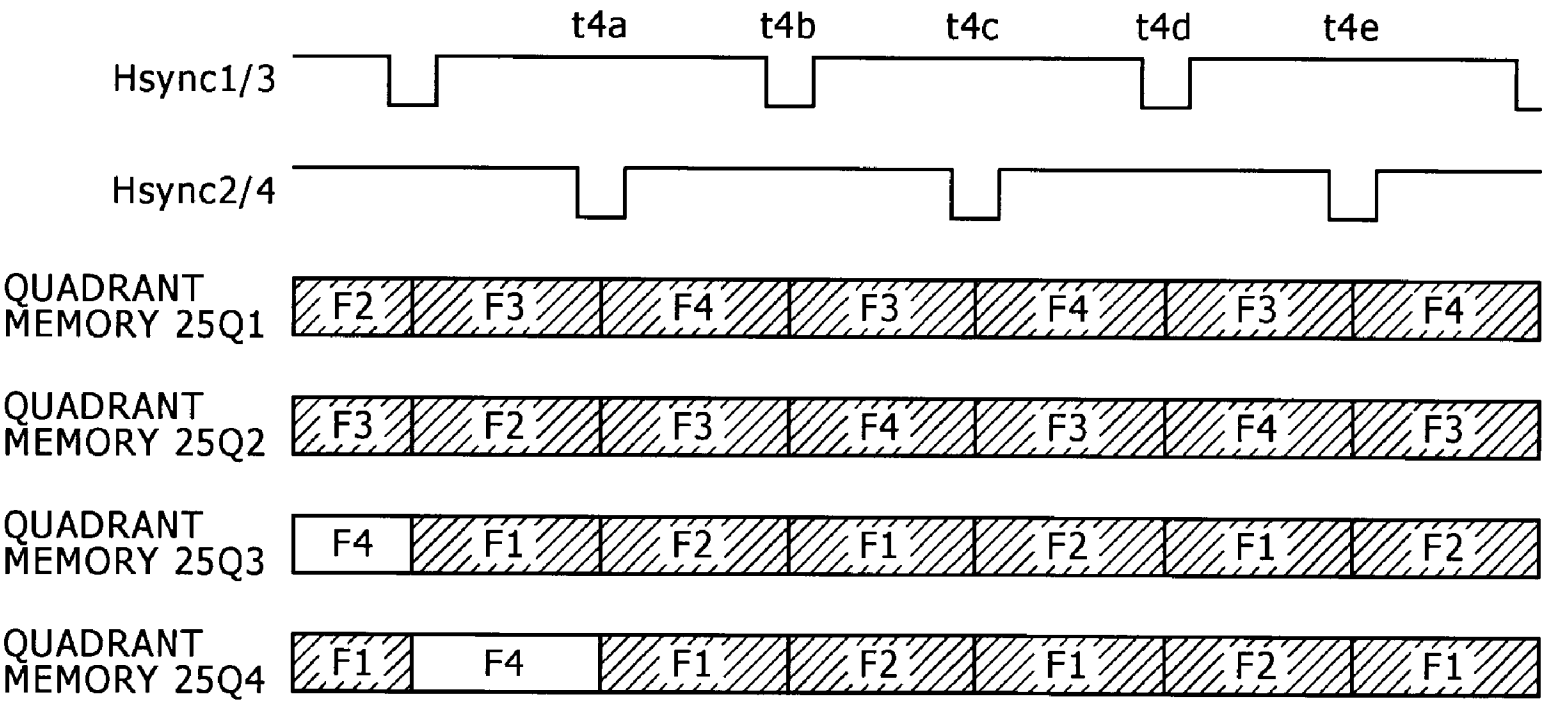
FIG. 12 is a timing diagram for describing the input control adapted to feed data to the quadrant memories of the server shown in FIG. 3.

The same is true for any other times, namely, any given time. For a timing diagram near time t2 in FIG. 4, for example, one need only refer to FIGS. 7 and 8. FIG. 7 is an enlarged view of a timing diagram 42. FIG. 8 is a timing diagram of the quadrant memories 25Q1 to 25Q4 in the same time zone (near time t2 in FIG. 4) as the timing diagram 42 of FIG. 7. For a timing diagram near time t3 in FIG. 4, for example, one need only refer to FIGS. 9 and 10. FIG. 9 is an enlarged view of a timing diagram 43. FIG. 10 is a timing diagram of the quadrant memories 25Q1 to 25Q4 in the same time zone (near time t3 in FIG. 4) as the timing diagram 43 of FIG. 9. For a timing diagram near time t4 in FIG. 4, for example, one need only refer to FIGS. 11 and 12. FIG. 11 is an enlarged view of a timing diagram 44. FIG. 12 is a timing diagram of the quadrant memories 25Q1 to 25Q4 in the same time zone (near time t4 in FIG. 4) as the timing diagram 44 of FIG. 11.

Thus, a description has been given, as an example, of the operation of the server 11 in FIG. 3 up to data input to (data storage in) the quadrant memories 25Q1 to 25Q4.

A description will now be given, as an example, of data output from the quadrant memories 25Q1 to 25Q4, namely, data output from the server 11 to the projector 12.

As illustrated in FIG. 4, the pieces of frame data F1 (represented by the pieces of data in the shaded areas in FIG. 4) are respectively assigned as the first to fourth quadrant data IQ1 to IQ4 and fed to (stored in) the quadrant memories 25Q1 to 25Q4 from time t1 to time t5.

That is, at time t5, the quadrant memories 25Q1 to 25Q4 respectively store the first to fourth quadrant data IQ1 to IQ4 for the pieces of frame data F1 (represented by the pieces of data in the shaded areas in FIG. 4).

Figure 13:
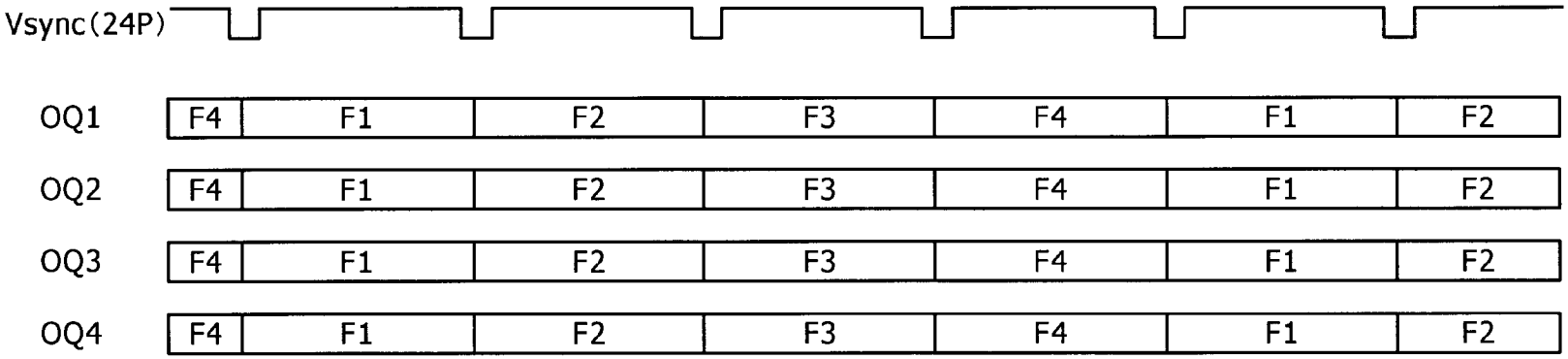
FIG. 13 is a timing diagram for describing output control adapted to read and output data from the quadrant memories of the server shown in FIG. 3.

As illustrated in FIG. 13, therefore, the output section 26 reads the first to fourth quadrant data IQ1 to IQ4 for the pieces of frame data F1 (represented by the pieces of data in the shaded areas in FIG. 4) respectively from the quadrant memories 25Q1 to 25Q4 at time t5 when the Vsync (24P) is output. The output section 26 reads the first to fourth quadrant data IQ1 to IQ4 in parallel as the first to fourth quadrant data OQ1 to OQ4 and outputs these pieces of data to the projector 12.

Further, the pieces of frame data F2 (represented by the pieces of data in the shaded areas in FIG. 4) are shifted by one period of the Vsync (24P) from the pieces of frame data F1 (represented by the pieces of data in the shaded areas in FIG. 4) and fed to the quadrant assignment section 24.

As illustrated in FIG. 4, therefore, the pieces of frame data F2 (represented by the pieces of data in the shaded areas in FIG. 4) are respectively assigned as the first to fourth quadrant data IQ1 to IQ4 and fed to (stored in) the quadrant memories 25Q1 to 25Q4 from time t2 to time t6.

That is, at a time when the Vsync (24P) is output following time t5 when the pieces of frame data F1 are output to the projector 12, namely, at time t6, the quadrant memories 25Q1 to 25Q4 respectively store the first to fourth quadrant data IQ1 to IQ4 for the pieces of frame data F2 (represented by the pieces of data in the shaded areas in FIG. 4).

As illustrated in FIG. 13, therefore, the output section 26 reads the first to fourth quadrant data IQ1 to IQ4 for the pieces of frame data F2 (represented by the pieces of data in the shaded areas in FIG. 4) respectively from the quadrant memories 25Q1 to 25Q4. The output section 26 reads the first to fourth quadrant data IQ1 to IQ4 in parallel at a time when the Vsync (24P) is output following time t5 when the pieces of frame data F1 are output to the projector 12, namely, at time t6, as the first to fourth quadrant data OQ1 to OQ4 and outputs these pieces of data to the projector 12.

In the same manner as above, the pieces of frame data F3 (represented by the pieces of data in the shaded areas in FIG. 4) are shifted by one period of the vsync (24P) from the pieces of frame data F2 (represented by the pieces of data in the shaded areas in FIG. 4) and fed to the quadrant assignment section 24.

Therefore, although only part thereof is shown in FIG. 4, the pieces of frame data F3 (represented by the pieces of data in the shaded areas in FIG. 4) are respectively assigned as the first to fourth quadrant data IQ1 to IQ4 and fed to (stored in) the quadrant memories 25Q1 to 25Q4 from time t3 to time t7 (refer to FIG. 13 for t7).

That is, at a time when the Vsync (24P) is output following time t6 when the pieces of frame data F2 are output to the projector 12, namely, at time t7, the quadrant memories 25Q1 to 25Q4 respectively store the first to fourth quadrant data IQ1 to IQ4 for the pieces of frame data F3 (represented by the pieces of data in the shaded areas in FIG. 4).

As illustrated in FIG. 13, therefore, the output section 26 reads the first to fourth quadrant data IQ1 to IQ4 for the pieces of frame data F3 (represented by the pieces of data in the shaded areas in FIG. 4) respectively from the quadrant memories 25Q1 to 25Q4. The output section 26 reads the first to fourth quadrant data IQ1 to IQ4 in parallel at a time when the Vsync (24P) is output following time t6 when the pieces of frame data F2 are output to the projector 12, namely, at time t7, as the first to fourth quadrant data OQ1 to OQ4 and outputs these pieces of data to the projector 12.

The pieces of frame data F4 (represented by the pieces of data in the shaded areas in FIG. 4) are shifted by one period of the Vsync (24P) from the pieces of frame data F3 (represented by the pieces of data in the shaded areas in FIG. 4) and fed to the quadrant assignment section 24.

Therefore, although only part thereof is shown in FIG. 4, the pieces of frame data F4 (represented by the pieces of data in the shaded areas in FIG. 4) are respectively assigned as the first to fourth quadrant data IQ1 to IQ4 and fed to (stored in) the quadrant memories 25Q1 to 25Q4 from time t4 to time t8 (refer to FIG. 13 for t8).

That is, at a time when the Vsync (24P) is output following time t7 when the pieces of frame data F3 are output to the projector 12, namely, at time t8, the quadrant memories 25Q1 to 25Q4 respectively store the first to fourth quadrant data IQ1 to IQ4 for the pieces of frame data F4 (represented by the pieces of data in the shaded areas in FIG. 4).

As illustrated in FIG. 13, therefore, the output section 26 reads the first to fourth quadrant data IQ1 to IQ4 for the pieces of frame data F4 (represented by the pieces of data in the shaded areas in FIG. 4) respectively from the quadrant memories 25Q1 to 25Q4. The output section 26 reads the first to fourth quadrant data IQ1 to IQ4 in parallel at a time when the Vsync (24P) is output following time t7 when the pieces of frame data F2 are output to the projector 12, namely, at time t8, as the first to fourth quadrant data OQ1 to OQ4 and outputs these pieces of data to the projector 12.

As described above, the four pieces of frame data F1 to F4 contained in a given unit (unit made up of four frames separated by the separation section 21) are sequentially output to the projector 12 according to the display order in synchronism with the Vsync (24P).

From that point onwards, the same operation will be repeated. That is, the four pieces of frame data F1 to F4 (represented by the pieces of data in the shaded areas in FIG. 4) contained in each of the units will be sequentially output to the projector 12 according to the display order in synchronism with the Vsync (24P).

To describe the above examples of operation from the viewpoint of the projector 12, each piece of frame data making up the 4K signal, namely, each piece of frame data having a pixel count of 4096×2160 (5500×2250 for the image frame)

is sequentially fed to the projector 12 in synchronism with the Vsync (24P). The time required to feed frame data having a pixel count of 4096×2160 (5500×2250 for the image frame) to the projector 12 is one frame (24P) of time as with the 2K signal.

Further, focusing on the write and read operations to and from the quadrant memories 25Q1 to 25Q4, the write operation to each of the memories requires only one line of time, and the read operation therefrom also requires only one line of time, as well. Therefore, the sample clock itself for each pixel need only be 74.25 MHz as with the 2K signal. As a result, the sample clock frequency including the overhead for accessing the memory need only be slightly higher than 74.25 MHz. That is, there is no need to increase the sample clock frequency four-fold.

In other words, the execution of the above operations by the server 11 means that the quadrant memory control (frame memory control for the 2K signal) is provided for the 4K signal at almost the same band (sample clock) as for the 2K signal. This ensures reduced power consumption and easy handling of devices.

A series of the above processes may be performed not only by hardware but also by software.

Figure 14:
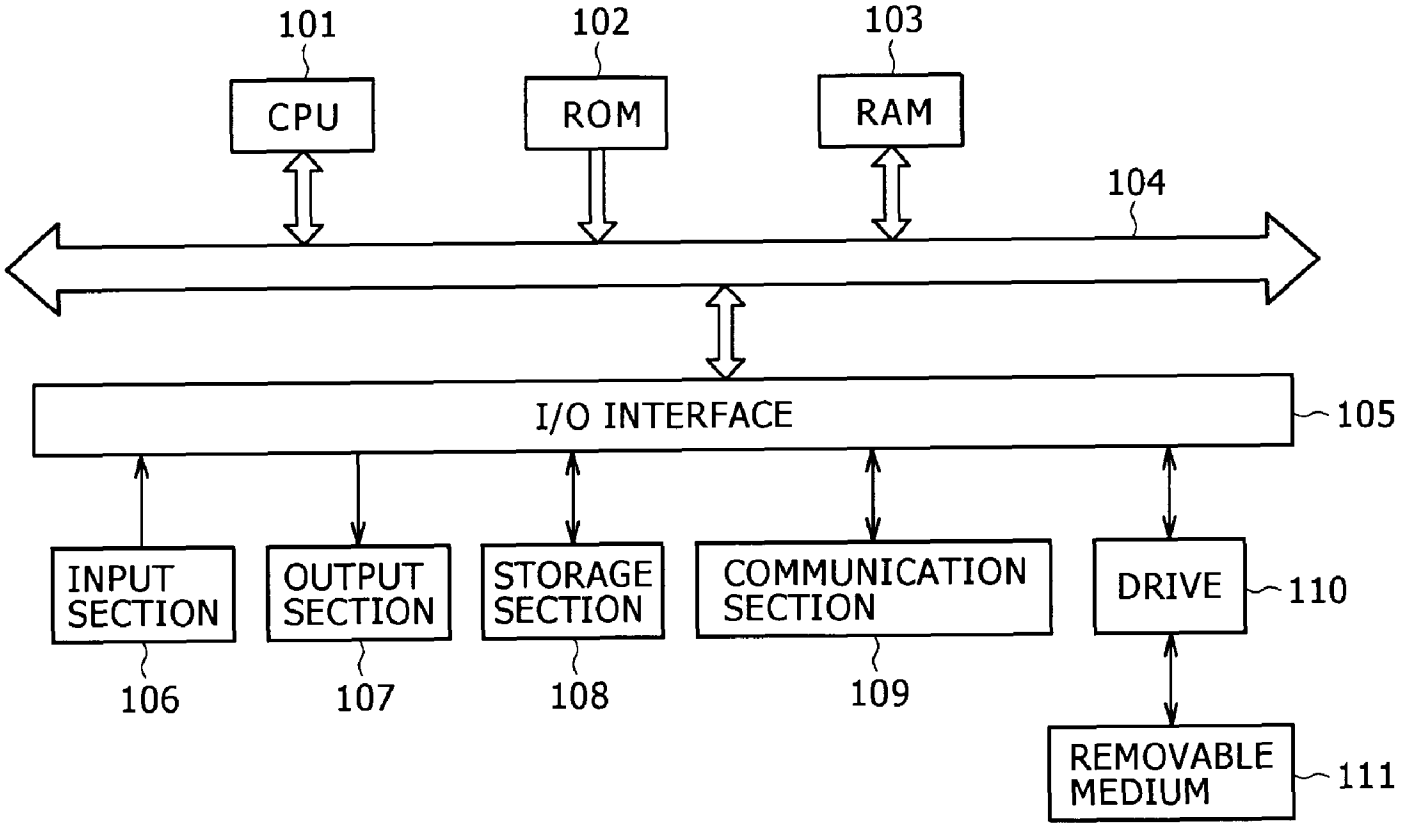
FIG. 14 is a block diagram illustrating a configuration example of a computer operable to control an image processing device to which the present invention is applied.

To perform a series of the above processes by software, the server 11 in FIG. 3 may be configured, in whole or in part, as a computer illustrated in FIG. 14.

In FIG. 14, a CPU (Central Processing Unit) 101 executes various processes according to the program stored in a ROM (Read Only Memory) 102 or that loaded into a RAM (Random Access Memory) 103 from a storage section 108. The RAM also stores, as appropriate, data and other information required for the CPU 101 to execute various processes.

The CPU101, ROM 102 and RAM 103 are connected with each other via a bus 104. An I/O interface 105 is also connected to the bus 104.

The I/O interface 105 has other sections connected thereto. Among such sections are an input section 106 such as keyboard or mouse, an output section 107 such as display, the storage section 108 which includes a hard disk, and a communication section 109 which includes a modem, terminal adapter and other devices. The communication section 109 controls communications with other equipment (not shown) via a network such as the Internet.

The I/O interface 105 has also a drive 110 connected thereto as necessary. A removable medium 111, which includes a magnetic, optical or magneto-optical disk or a semiconductor memory, is attached thereto as appropriate. Computer programs read therefrom are installed to the storage section 108 as necessary.

To perform a series of the above processes by software, a computer with dedicated hardware is used. The dedicated hardware is preinstalled with the program making up the software. Alternatively, a general-purpose personal computer or other types of computer may also be used which can perform various functions when various programs are installed thereto. Such programs are installed via a network or from a recording medium.

The recording medium containing such programs is distributed separately from the device itself to provide viewers with the programs as illustrated in FIG. 14. The recording medium may include the removable medium (package medium) ill such as magnetic disk (including floppy disk), optical disk (including CD-ROM (Compact Disk-Read Only Memory) and DVD (Digital Versatile Disk)), a magneto-optical disk (MD (Mini-Disk)) or a semiconductor memory. Alternatively, the recording medium may include the ROM 102 storing the programs to be provided to the viewers as preinstalled to the main body of the device. Still alternatively, the recording medium may include a hard disk contained in the storage section 108 or other medium.

It should be noted that, in the present specification, the step of describing the programs to be recorded in the recording medium includes not only those processes to be performed chronologically in the sequence of description but also other processes which are not necessarily performed chronologically but rather in parallel or individually.

On the other hand, the term "system" refers, in the present specification, to a whole device made up of a plurality of devices and processing sections.

As described above, the moving image signal to which the present invention is applied is not specifically limited to the 4K signal, and any other signal can also be used. The unit image signals making up the moving image signal are not limited to frame signals (frame data), and any other signals such as field signals (field data) can also be used so long as they can serve as units for image processing.

The image processing device to which the present invention is applied is not limited to the embodiment described in FIG. 3, but may take various other forms.

That is, the image processing device may be implemented in any manner so long as it is configured as follows. That is, the image processing device controls a display device to display a plurality of unit images making up a moving image. The display device sequentially displays the plurality of unit images at predetermined intervals. The image processing device includes 4×N (N: an arbitrary integer) quadrant memories, each associated with one of 4×N types of quadrant images into which the unit image is divided. The image processing device further includes a separation section adapted to separate a moving image signal for the moving image into unit image signals. Each of the unit image signals is associated with one of the 4×N unit images to be displayed successively in time. The image processing device still further includes a memory output control section. The memory output control section sequentially delays the output start timing of each of the 4×N unit image signals, separated by the separation section, to the quadrant memory by the predetermined interval in synchronism with a synchronizing signal as output control. Further, the memory output control section sequentially outputs quadrant image signals in a predetermined order over a period equal to 4×N times the predetermined interval. Each of the quadrant image signals is associated with one of the 4×N types of quadrant images. The image processing device still further includes an assignment section. The assignment section assigns and feeds each of the 4×N unit image signals, output under the control of the memory output control section, to one of the quadrant memories which is associated with the type of quadrant image signal output at that point in time. The image processing device still further includes an output control section. The output control section treats each of the 4×N unit images as an image to be displayed in a display order. The same section reads, in synchronism with the synchronizing signal, the quadrant image signals, each of which is associated with one of the 4×N types of quadrant images into which the image to be displayed is divided. The same section reads the quadrant image signals from the 4×N types of quadrant memories and outputs the signals to the display device.

It should be understood by those skilled in the art that various modifications, combinations, sub-combinations and alterations may occur depending on design requirements and other factors insofar as they are within the scope of the appended claims or the equivalents thereof.

What is claimed is:

1. An image processing device for controlling a display device to display a plurality of frame or field images making up a moving image at frame or field intervals, the image processing device comprising:

4×N (N: an arbitrary natural number) quadrant memories, each associated with one of 4×N types of quadrant images into which each of the frame or field images is divided;

a separation section adapted to separate a moving image signal for the moving image into a series of 4×N frame or field image signals, each of which is associated with one of 4×N successive frame or field images to be displayed successively in time;

a timing control section adapted to control a timing of each of the 4×N frame or field image signals, which are separated by the separation section, to be sequentially delayed by the frame or field interval, the timing control section being further adapted to control quadrant parts of the 4×N frame or field image signals, each of which quadrant parts is associated with one of the 4×N types of the quadrant images, to be sequentially output in a predetermined order, each of the 4×N frame or field image signals being output in a time-expanding manner over a period equal to 4×N times the frame or field interval;

an assignment section adapted to assign and feed each of the quadrant parts of the 4×N frame or field image signals, which is output under the control of the timing control section, to a corresponding one of the 4×N quadrant memories which is associated with the type of the quadrant parts being output at that point in time; and an output control section adapted to control each of the 4×N frame or field images to be displayed on the display device in a display order, by reading from the 4×N quadrant memories and outputting to the display device at the frame or field intervals, the quadrant parts of the 4×N frame or field image signals, each of which quadrant parts is associated with one of the 4×N types of the quadrant images into which each of the frame or field images to be displayed is divided.

2. The image processing device of claim 1, wherein, each of the plurality of the frame or field image signals making up the moving image signal has a resolution four times that of a high definition signal, there are first to fourth types of quadrant images of equal size into which each of the field or frame images is divided, and each of the quadrant parts of the frame or field image signals, each associated with one of the first to fourth quadrant images, have a resolution of the high definition signal.

3. The image processing device of claim 2, wherein, the display device is a projector adapted to receive the moving image signal in a first format and to project a moving image for the moving image signal received, the separation section is supplied with the moving image signal in a second format which is different from the first format, and the output control section converts the moving image signal from the second format to the first format and outputs the moving image signal to the display device in the first format.

4. The image processing device of claim 3, wherein, the projector has four input lines for receiving the quadrant parts of the frame or field image signals and projects an original frame or field image using the four quadrant parts of the frame or field image signals received through the four input lines, and the output control section outputs the quadrant parts of the frame or filed image signals, each of which quadrant parts is associated with one of the first to fourth types of quadrant images, to the four input lines of the projector, respectively.

5. An image processing method for controlling an image processing device that controls a display device to display a plurality of frame or field images making up a moving image at frame or field intervals, the image processing device including 4×N (N: an arbitrary natural number) quadrant memories, each associated with one of 4×N types of quadrant images into which each of the frame or field images is divided, the image processing method comprising:

separating a moving image signal for the moving image into a series of 4×N frame or field image signals, each of which is associated with one of 4×N successive frame or field images to be displayed successively in time;

controlling a timing of each of the 4×N frame or field image signals, separated in the separating, to be sequentially delayed by the frame or field interval, and controlling quadrant parts of the 4×N frame or field image signals, each of which quadrant parts is associated with one of the 4×N types of the quadrant images, to be sequentially output in a predetermined order, each of the 4×N frame or field image signals being output in a time-expanding manner over a period equal to 4×N times the frame or field interval;

assigning and feeding each of the quadrant parts of the 4×N frame or field image signals, which has been sequentially output, to a corresponding one of the 4×N quadrant memories which is associated with the type of the quadrant parts being output at that point in time; and controlling each of the 4×N frame or field images to be displayed on the display device in a display order, by reading from the 4×N quadrant memories and outputting to the display device, at the frame or field intervals, the quadrant parts of the 4×N frame or field image signals, each of which quadrant parts is associated with one of the 4×N types of the quadrant images into which each of the frame or field images to be displayed is divided.

6. A non-transitory computer-readable medium having instructions recorded thereon that when executed by a processor causes the processor to perform a process to control an image processing device operable to control a display device to display a plurality of frame or field images making up a moving image at frame or field intervals, the image processing device including 4×N (N: an arbitrary natural number) quadrant memories, each associated with one of 4×N types of quadrant images into which each of the frame or field images is divided, the process comprising:

separating a moving image signal for the moving image into a series of 4×N frame or field image signals, each of which is associated with one of 4×N successive frame or field images to be displayed successively in time;

controlling a timing of each of the 4×N frame or field image signals, separated in the separating, to be sequentially delayed by the frame or field interval and controlling quadrant parts of the 4×N frame or field image signals, each of which quadrant parts is associated with one of the 4×N types of the quadrant images, to be sequentially output in a predetermined order, each of the 4×N frame or field image signals being output in a time-expanding manner over a period equal to 4×N times the frame or field interval;

assigning and feeding each of the quadrant parts of the 4×N frame or field image signals, which has been sequentially output, to a corresponding one of the 4×N quadrant memories which is associated with the type of the quadrant parts being output at that point in time; and controlling each of the 4×N frame or field images to be displayed on the display device in a display order, by reading from the 4×N quadrant memories and outputting to the display device, at the frame or field intervals, the quadrant parts of the 4×N frame or field image signals, each of which quadrant parts is associated with one of the 4×N types of the quadrant images into which each of the frame or field images to be displayed is divided.

* * * * *